US007121930B2

(12) United States Patent
Thyssen

(10) Patent No.: US 7,121,930 B2
(45) Date of Patent: Oct. 17, 2006

(54) PROCESS AND DRESSING TOOL FOR THE DRESSING OF CYLINDRICAL GRINDING WORMS FOR THE CONTINUOUS GENERATION GRINDING OF GEARS

(75) Inventor: Wolfgang Thyssen, Bad Sackingen (DE)

(73) Assignee: Reishauer AG, Wallisellen (CH)

( * ) Notice: Subject to any disclaimer, the term of this patent is extended or adjusted under 35 U.S.C. 154(b) by 0 days.

(21) Appl. No.: 11/115,257

(22) Filed: Apr. 27, 2005

(65) Prior Publication Data

US 2005/0245176 A1 Nov. 3, 2005

(30) Foreign Application Priority Data

Apr. 28, 2004 (DE) ..... 10 2004 020 947

(51) Int. Cl.
*B24B 53/075* (2006.01)

(52) U.S. Cl. ..... 451/56; 451/47; 451/5

(58) Field of Classification Search ..... 451/47, 451/5, 56, 72; 125/11.03, 11.04
See application file for complete search history.

(56) References Cited

U.S. PATENT DOCUMENTS 2,571,293 A 10/1951 Ross et al.
4,993,194 A * 2/1991 Cadisch ..... 451/253
5,339,794 A 8/1994 Thyssen
6,234,880 B1 * 5/2001 Scacchi ..... 451/47
6,491,568 B1 * 12/2002 Jankowski ..... 451/5

FOREIGN PATENT DOCUMENTS

| | | | |
|---|---|---|---|
| CH | 686171 | 1/1996 | |
| DE | 7003805 | 1/1970 | |
| DE | 3235790 | 4/1983 | |
| SU | 0982881 | * 12/1982 | ..... 125/11.04 |

* cited by examiner

*Primary Examiner*—Robert A. Rose
(74) *Attorney, Agent, or Firm*—Browdy and Neimark, PLLC

(57) ABSTRACT

A rotating dressing tool (2) coated with abrasive grains for profiling a multi-start grinding worm (4) for the continuous generation grinding of preferably small moduled gear teeth is provided with a stripping zone (6), a pre-profiling zone (7) and a finish profiling zone (8). After being swivelled into their dressing position about a swivel axis (F) at right angles to the axis of rotation of the dressing tool, the profiling zones are brought one after the other into engagement with the grinding worm (4). The number of profile ribs in the pre-profiling zone and finish profiling zone is equal to or greater than the number of thread starts on the grinding worm.

29 Claims, 4 Drawing Sheets

PROCESS AND DRESSING TOOL FOR THE DRESSING OF CYLINDRICAL GRINDING WORMS FOR THE CONTINUOUS GENERATION GRINDING OF GEARS

FIELD OF THE INVENTION

The present invention concerns a dressing process and a dressing tool. In particular the invention concerns the dressing of a multi-start cylindrical grinding worm, preferably a grinding worm with vitrified bond, for the grinding of the tooth flanks of a gear, in particular of a small moduled gear, by the continuous generation process by means of a rotating disc shaped, abrasive coated dressing tool. The dressing embraces the functions of pre-profiling and finish profiling or calibration of the grinding worm threads, and preferably also the stripping of the grinding worm periphery.

BACKGROUND OF THE INVENTION

For the dressing of cylindrical grinding worms for the continuous generation grinding of gears in the module range of 1 to 3 mm, gang rolls or full profile rolls are often employed which enclose the desired grinding worm profile over one or more threads. One such tool is known e.g. from CH 686 171 A5, which by a special construction permits the re-machining of the diamond coating of a composite diamond dressing tool for dressing both threads of a two-start cylindrical grinding worm.

Especially in the case of workpiece teeth with a module of less than 1 mm, however, so-called full profile rolls with 3 to 5 profile ribs are used which, in similar manner as a thread dressing roll, simultaneously enclose 3 to 5 adjacent threads of the total grinding worm profile. Such a profile roll is shown in FIG. 1 in mesh with a grinding worm.

A disadvantage of these full profile rolls is that a re-machining of the abrasive coating to correct the flank geometry and to assure adequate surface quality of the ground gears is as yet technically unattainable, and that they must therefore be produced by the very expensive and time consuming negative or reversal process. This means that towards the end of the dressing process the grinding worm threads must be brought one after the other into mesh with several different profile ribs of the dressing tool without further dressing infeed, in order to reduce the effective roughness depth of the grinding worm flanks to the permissible value and to "calibrate" the profile.

For the continuous generation grinding of fine and ultra-fine teeth in the module range up to 1 mm, multi-start grinding worms with more than 5 starts are generally employed. For such grinding worms the well known above mentioned full profile rolls have an inadequate number of ribs available to profile all the grinding worm threads simultaneously, i.e. in the same dressing stroke. For this reason, to produce all the grinding worm threads of these grinding worms when pre-profiling, the profile roll must be put into action axially displaced several times. FIG. 2 shows a three-ribbed profile roll 2 in a first axial dressing position Y1 in a first, second (Y1') and third (Y1") grinding worm revolution of a five-start grinding worm with a lead H for producing the first three of the five grinding worm threads. To pre-profile the two remaining grinding worm threads the profile roll is brought to a second dressing position Y2 and Y2', which is axially displaced by two profiling ribs relative to the first dressing position Y1, Y1', Y1". Since the number of grinding worm starts and the number of ribs on the profile roll are not of an integer ratio, the profile rib flanks of the dressing tool are subject to unequal wear due to unequal use, which causes losses in accuracy when subsequently finish profiling.

Another disadvantage of the number of profile ribs being less than the number of grinding worm starts is that the ribs provided on the dressing tool must perform both the pre-profiling work and the finish profiling work. This means that the quality of the finish profiling, i.e. the calibration quality is impaired by the far greater wear of the abrasive coating during pre-profiling.

The disadvantages mentioned above make it apparent that the known full profile rolls with 3 to 5 profile ribs are unsuitable for the profiling of multi-start small moduled grinding worms.

Furthermore in the generation grinding of fine teeth as opposed to the grinding of large moduled workpieces it is usual, when changing over to a new workpiece, to remove the grinding worm profile no longer required, and to profile the grinding worm completely freshly. Since the abrasive profile of the known profile rolls is not suitable for the stripping or removal of the grinding worm profiles no longer required, a separate tool suitable for this expressed purpose must be provided on the machine, or the grinding worm must be removed from the machine to strip it, which makes breaking down and fresh setting up necessary.

SUMMARY OF THE INVENTION

One object of the present invention is to provide a process for dressing a multi-start cylindrical grinding worm for grinding the tooth flanks of a gear, in particular of a small moduled gear, by the continuous generation grinding process and a dressing tool, by and with which the grinding worm can be re-profiled with high precision or provided with a new grinding worm profile.

This object is achieved with a process and a dressing tool having the features stated in claims 1 and 6 respectively.

According to the invention the production of a new or freshly dressed grinding worm profile is performed by means of a dressing tool which is provided with a pre-profiling zone and a finish profiling or calibration zone. These are brought into engagement with the grinding worm in separate consecutive machining operations in a single set-up of the grinding worm and the dressing tool.

Preferably the pre-profiling zone at least is provided with a dressing profile which encloses the grinding worm profile over at least the entire lead of the grinding worm thread.

Another object of the invention is to provide a process and a dressing tool for the dressing of a multi-start cylindrical grinding worm for the grinding of the tooth flanks of a gear, in particular of a small moduled gear, by the continuous generation grinding process, by and with which a grinding worm profile no longer required can be replaced by a new one in the shortest possible time.

This object is achieved with a process and a dressing tool having the features stated in claim 2 and 8 respectively.

According to the invention the stripping of a grinding worm profile no longer needed is performed with the dressing tool mentioned above, which tool is additionally provided with a stripping zone. The stripping zone, pre-profiling zone and finish profiling or calibration zone are brought into engagement with the grinding worm consecutively.

Since the set-up of the grinding worm and the dressing tool does not have to be changed either on change-over from stripping to pre-profiling or from pre-profiling to finish profiling, the grinding worm can be stripped and profiled in double quick time. Exchanging of the grinding worm when changing over to a new workpiece is no longer necessary. A grinding worm profile no longer needed can nevertheless be removed and a new one produced and calibrated for every workpiece.

The process according to the invention and the device according to the invention particularly are suitable for grinding worms with vitrified bond and/or for small moduled gears, i.e. below module 1 mm.

Further beneficial features of the invention are evident from the relevant claims.

BRIEF DESCRIPTION OF THE DRAWINGS

In the following the invention is explained in detail by way of a few preferred embodiments which are illustrated in the annexed drawings. The drawings depict.

DETAILED DESCRIPTION OF PREFERRED EMBODIMENTS

Figure 1:
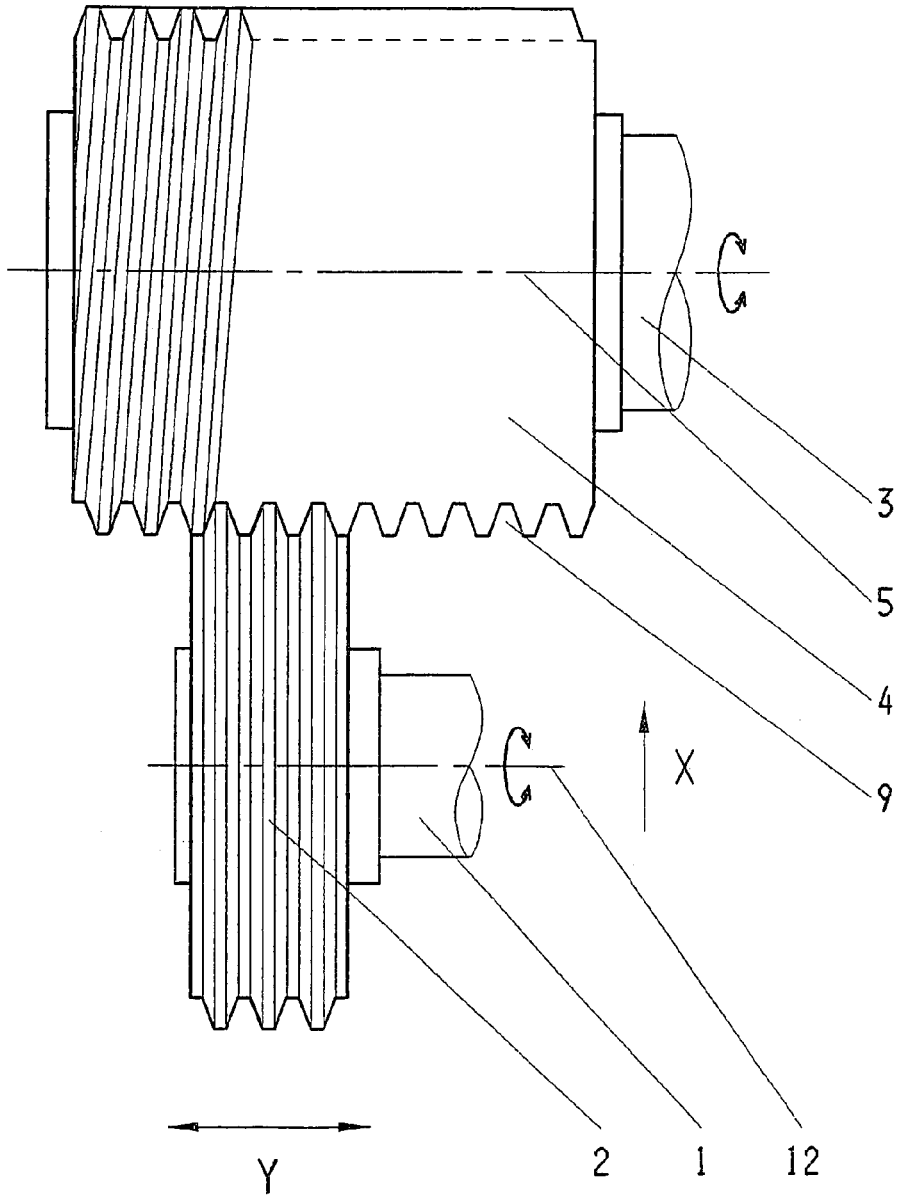
Fig. 1 PRIOR ART
FIG. 1 A diagrammatic representation of a profile roll in engagement with a grinding worm according to the background of the invention, FIG. 2 A portional diagrammatic representation of various positions of engagement of a profile roll during dressing according to the background of the invention, FIG. 3 A diagrammatic representation of a profile roll according to the invention in a first embodiment, and FIG. 4 A diagrammatic representation of a profile roll according to the invention in a second embodiment.

FIG. 1 shows a diagrammatic representation of a three-ribbed, abrasive grain coated dressing or profile roll 2 fitted to a rotating dressing spindle 1, which said roll 2 is engaged with a cylindrical grinding worm 4 fitted to a rotating grinding spindle 3. The dressing of the grinding worm profile 9, more precisely of the worm thread profile, takes place by means of several dressing strokes of the profile roll 2 in the stroke direction Y parallel to the axis of rotation 5 of the grinding worm 4.

Figure 2:
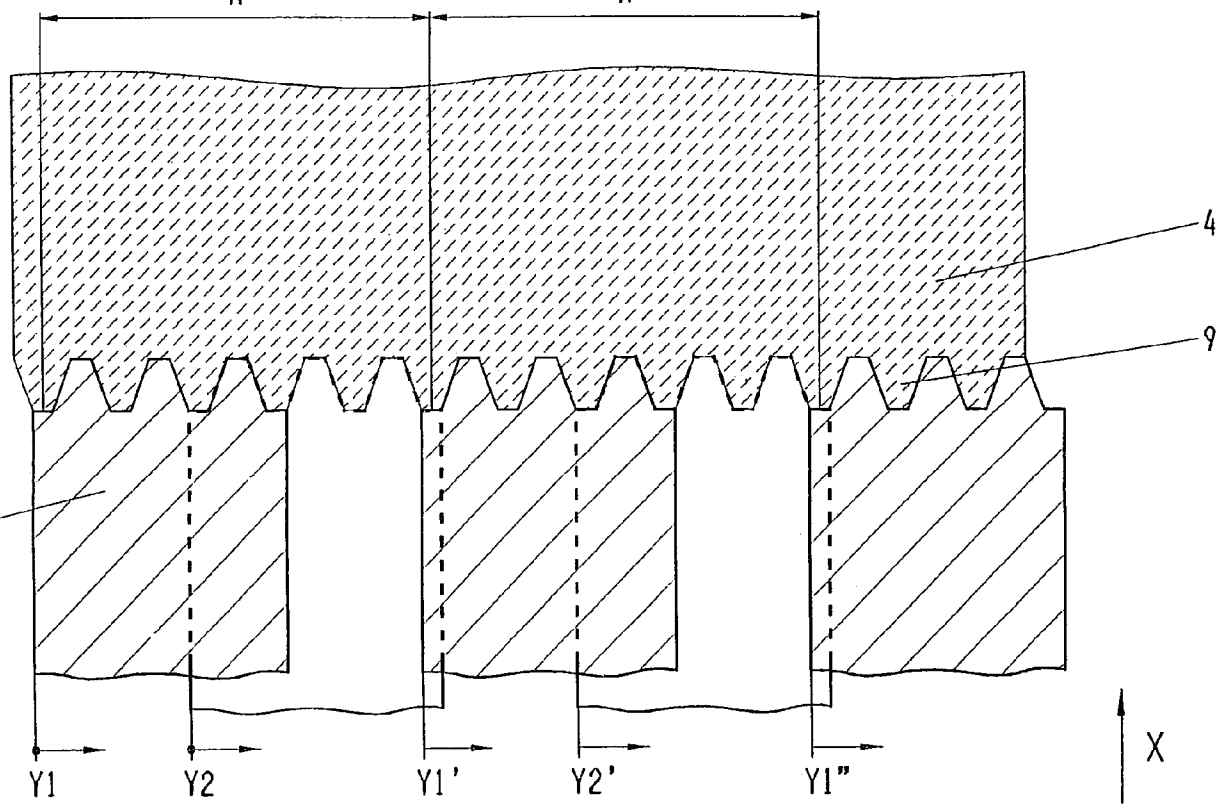
Fig.2 PRIOR ART

FIG. 2 shows portionally, as already mentioned above, a three-ribbed profile roll 2 in a first axial dressing position Y1 in a first, second (Y1') and third (Y1") grinding worm revolution for the production of the first three threads of the five-start grinding worm 4 with a thread lead of H. For pre-profiling the two remaining grinding worm threads the profile roll 2 is located in a second dressing position Y2 and Y2', which is axially displaced by two profiling ribs relative to the first dressing position Y1, Y1', Y1". Thereby, in the two dressing positions, a re-profiling of one of the grinding worm threads already produced beforehand takes place, which results in pitch deviations.

Figure 3:
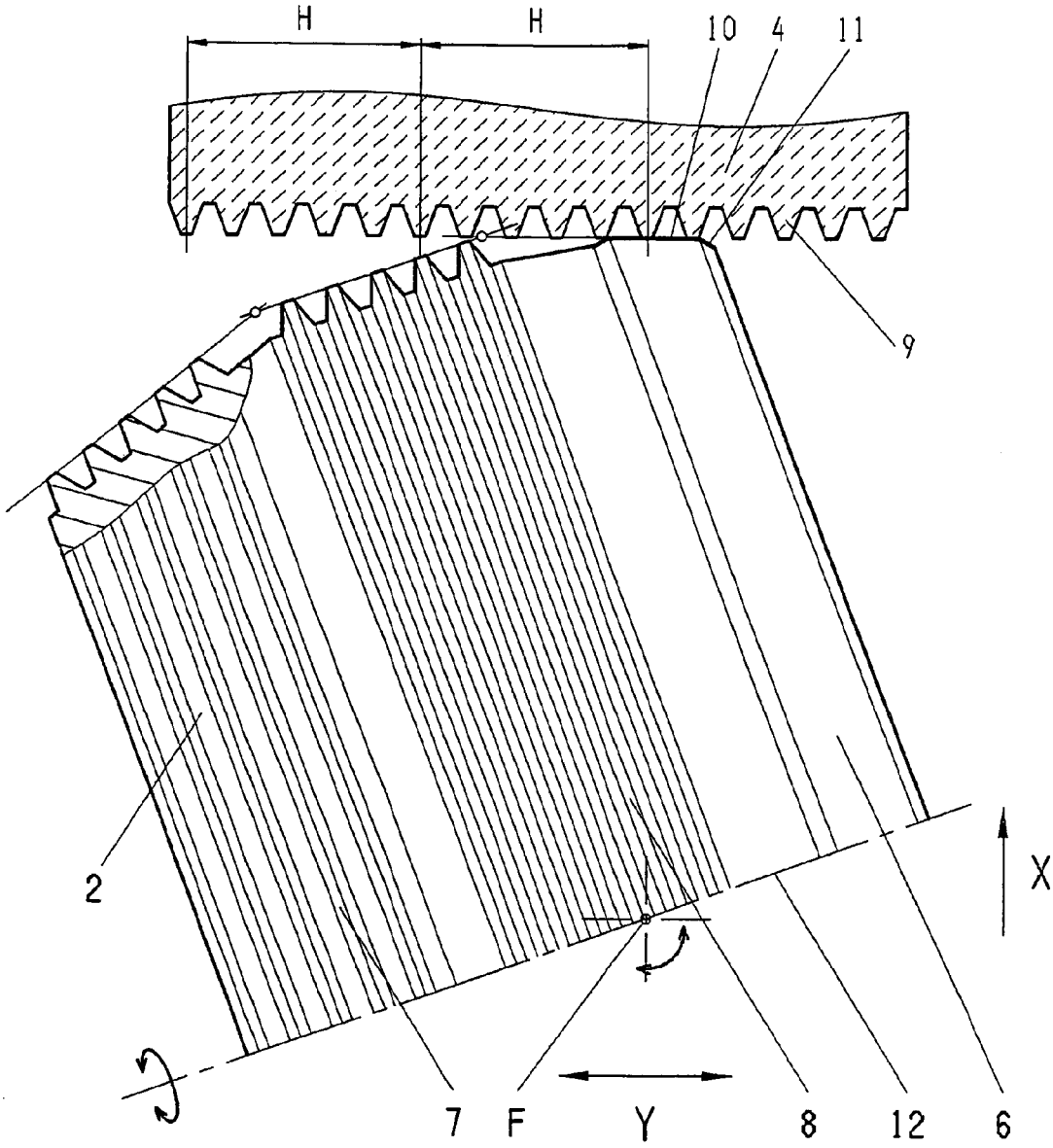

Depicted in FIG. 3 is a first embodiment of a dressing or profile roll according to the invention for the dressing of a cylindrical grinding worm for the continuous generation grinding of fine and ultra-fine gear teeth. This too is provided with a ribbed profile which is reproduced on the grinding worm 4. It is attachable to a dressing spindle 1 and rotatable about its axis of rotation 12.

The basis for the solution according to the invention is presented by the known methods of profiling cylindrical grinding worms for continuous generation grinding, and by the special requirements in the manufacture of fine gear teeth in the module range of less than 1 mm by means of multi-start grinding worms.

The profile of the dressing tool 2 comprises at least two, here three, different profile zones 6, 7, 8 separated from each other by zones without profile ribs. These profile zones 6, 7, 8 can be brought individually into engagement with the grinding worm in any desired sequence without another zone colliding, in that the profile roll 2 is firstly swivelled about a swivel axis F at right angles to its axis of rotation 12, and then infed in the infeed direction X.

Two of the profile zones 7, 8 serve to consecutively pre-profile and finish profile the grinding worm threads. The other profile zone 6 is optional and serves to strip the grinding worm profile away. This stripping zone 6 has the shape of a truncated cone with familiar straight or crowned, i.e. cambered enveloping surface 10 and lead lands 11. The pre-profiling zone 7, likewise in the form of a truncated cone, and the preferably cylindrical finish profiling zone 8 are provided with the negative profile of the grinding worm 4. The number of profile ribs in the pre-profiling zone 7 corresponds with the number of starts on the grinding worm. The number of profile ribs in the finish profiling, i.e. calibration zone 8 can be less than the number of grinding worm starts. Preferably, however, it should be of equal number or of a larger number than this.

Finish profiling, i.e. calibration of the grinding worm threads is performed in the known manner, in that the profile ribs of the finish profiling zone 8 are allocated variously one after the other to the individual grinding worm threads without or with only minimum further dressing infeed, so that every grinding worm thread is finish dressed by several profile ribs. In order to minimize the necessary number of finish profiling strokes, the number of profile ribs in the finish profiling zone 8 is preferably a few calibration ribs more than the number of grinding worm starts. In every finish profiling, i.e. calibration dressing stroke all the grinding worm threads are always calibrated together, the desired effective roughness depth of the grinding worm 4 thereby being attained in the most effective manner.

The profiling zones 6, 7, 8 can be combined on a single tool or preferably composed of individual discs joined to form a gang tool, their abrasive coating differing, especially in the case of the composite design, with respect to at least one of the following features: type, grain size, coating pattern, density and bond. These features are adapted optimally to the relevant operative purpose.

Figure 4:
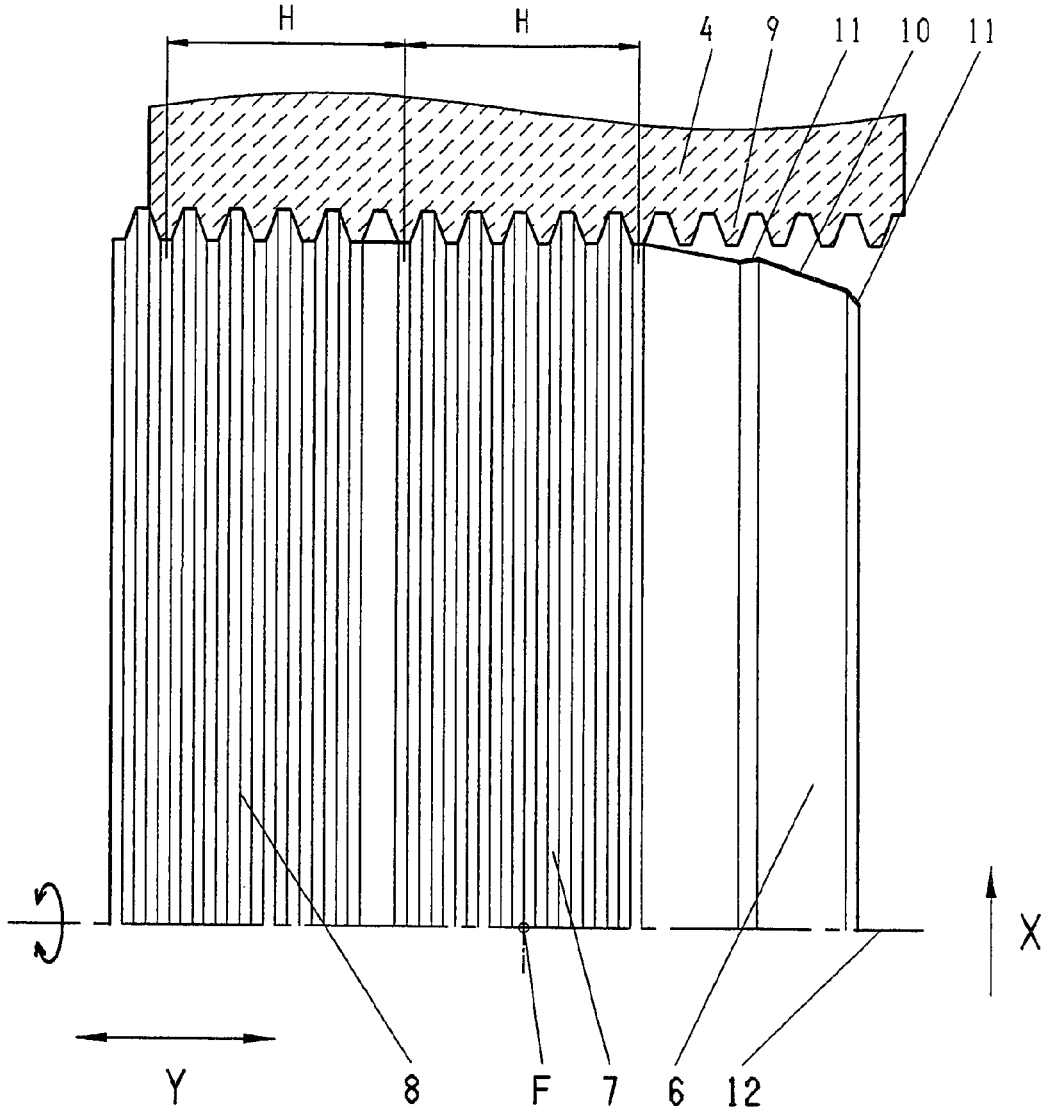

In a second embodiment of the dressing tool according to the invention, i.e. the profile roll 2 depicted in FIG. 4, the pre-profiling zone 7 and the finish profiling or calibration zone 8 are arranged in the same angle of swivel. In a first variant of this embodiment, which is shown here, these two profile zones 7, 8 are arranged on coaxial cylinder surfaces of the dressing tool with the same diameter. Finish profiling thus takes place exclusively as calibration without fresh radial dressing infeed.

In a second variant the finish profiling zone 8 has a greater diameter than the pre-profiling zone 7. Preferably it is greater than the diameter of the pre-profiling zone 7 by at least twice the amount of a desired finish profiling infeed depth. In this case finish profiling takes place with an infeed depth corresponding to half the diameter difference between the profiling zones 7, 8. In both cases it must be ensured that when dressing the grinding worm 4 the pre-profiling zone 7 always runs ahead of the finish profiling zone 8. With these two variants of the profile roll 2, therefore, profiling can only be performed in one of the two dressing stroke directions Y. In a third variant of these two embodiments separate pre-profiling zones 7 are provided on both sides of the finish profiling zone 8. Profiling can thereby be performed in both dressing stroke directions Y.

In the embodiment according to FIG. 4 and the variants described above, the stripping zone 6 can be optionally provided. Here too this stripping zone 6 is arranged at an angle relative to the profiling zones 7, 8, which permits a stripping of the grinding worm profile without the grinding worm colliding with the other profiling zones. The stripping zone 6 can, however, also be arranged on an additional dressing spindle as a separate tool.

In all the embodiments described above, the pre-profiling zone 7 and the finish profiling zone 8 and, if provided, the stripping zone 6 are each at a conical angle and a spacing from one to the other, the angle and spacing being so dimensioned that each of these zones 6, 7, 8 can be brought into engagement with the grinding worm 4 without any other of these zones colliding.

LIST OF REFERENCE NUMBERS

1 Dressing spindle
2 Profile roll
3 Grinding spindle
4 Grinding worm
5 Axis of rotation of grinding worm
6 Stripping zone
7 Pre-profiling zone
8 Finish profiling zone
9 Grinding worm profile
10 Enveloping surface
11 Lead land
12 Axis of rotation of profile roll
F Swivel axis
H Grinding worm lead
Y Dressing stroke direction
Y1 $1^{st}$ axial dressing position
Y1' $1^{st}$ axial dressing position in second grinding worm revolution
Y1" $1^{st}$ axial dressing position in third grinding worm revolution
Y2 $2^{nd}$ axial dressing position
Y2' $2^{nd}$ axial dressing position in second grinding worm revolution
X Infeed direction

The invention claimed is:

1. Process for the dressing of a multi-start cylindrical grinding worm (4) for grinding the tooth flanks of a gear by the continuous generation grinding process, where by the reproduction of a rib profile of a dressing tool (2) on the grinding worm a grinding worm profile (9) is produced, wherein the grinding worm profile is produced in that the grinding worm (4) is pre-profiled by means of a pre-profiling zone (7) of the dressing tool (2), said pre-profiling zone (7) comprising a plurality of first profiling ribs, and in the same set-up of the grinding worm (4) and the dressing tool (2) the grinding worm (4) is finish profiled by means of a, finish profiling zone (8) of the dressing tool (2), said finish profiling zone (8) comprising a plurality of second profiling ribs, pre-profiling being performed in a first machining operation and finish profiling being performed in a second machining operation, and these machining operations being performed separately one after the other.

2. Process according to claim 1, wherein the dressing tool (2) is swivelled about an axis (F) at right angles to the axis of rotation of the dressing tool (2) and the pre-profiling zone (7) and the finish profiling zone (8) are brought into dressing position by means of this swivel action.

3. Dressing tool for dressing a multi-start cylindrical grinding worm (4) for grinding the tooth flanks of a gear by the continuous generation grinding process, wherein its periphery is provided with a pre-profiling zone (7) comprising a plurality of first profiling ribs, for the pre-profiling of the grinding worm (4) and a finish profiling zone (8) comprising a plurality of second profiling ribs, for the finish profiling of the grinding worm (4), where these two profiling zones (7, 8) can be brought into engagement with the grinding worm in separate consecutive machining operations.

4. Dressing tool according to claim 3, wherein it has an axis of rotation (12), and the pre-profiling zone (7) and the finish profiling zone (8) are arranged next to each other along this axis of rotation (12).

5. Dressing tool according to claim 4, wherein the periphery of the dressing tool (2) is provided with a stripping zone (6) for stripping the grinding worm (4), where the stripping zone (6), the pre-profiling zone (7) and the finish profiling zone (8) can be brought into engagement with the grinding worm (4) in consecutive machining operations.

6. Dressing tool according to claim 3, wherein the pre-profiling zone (7) has a number of profiling ribs at least equal to the number of grinding worm starts.

7. Dressing tool according to claim 3, wherein the finish profiling zone (8) has a number of profiling ribs at least equal to or greater than the number of grinding worm starts.

8. Dressing tool according to claim 3, wherein it is provided with an enveloping surface and the pre-profiling zone (7) and the finish profiling zone (8) are arranged on this enveloping surface, where these zones (7, 8) are each provided with a conical enveloping surface having a conical angle and a spacing from one to the other, the angle and spacing being so dimensioned that each of these zones (7, 8) can be brought into engagement with the grinding worm (4) without any other of these zones (7, 8) colliding.

9. Dressing tool according to claim 3, wherein it is swivellable about a swivel axis (F) which is at right angles to an axis (12) of a dressing spindle (1) of the dressing tool (1), and the pre-profiling zone (7) and the finish profiling zone (8) can be brought into dressing position by this swivel action.

10. Dressing tool according to claim 3, wherein the pre-profiling zone (7) and the finish profiling zone (8) are arranged on coaxial cylindrical surfaces of the dressing tool (2) with equal diameter.

11. Dressing tool according to claim 3, wherein the pre-profiling zone (7) and the finish profiling zone (8) are arranged on coaxial cylindrical surfaces of the dressing tool (2), where the diameter of the finish profiling zone (8) is greater than the diameter of the pre-profiling zone (7) by twice the amount of a desired finish profiling infeed depth.

12. Dressing tool according to claim 3, wherein the abrasive coatings of the pre-profiling zone (7), the finish profiling zone (8) and, if provided, the stripping zone (6) differ from each other in at least one of the following properties: type of abrasive, grain size, coating pattern, density, bond.

13. Process for the dressing of a multi-start cylindrical grinding worm (4) for grinding the tooth flanks of a gear by the continuous generation grinding process, whereby the reproduction of a rib profile of a dressing tool (2) on the grinding worm a grinding worm profile (9) is produced, wherein the grinding worm profile is produced in that the grinding worm (4) is pre-profiled by means of a pre-profiling zone (7) of the dressing tool (2), and in the same set-up of the grinding worm (4) and the dressing tool (2) the grinding worm (4) is finish profiled by means of a finish profiling zone (8) of the dressing tool (2), pre-profiling being performed in a first machining operation and finish profiling being performed in a second machining operation, and these machining operations being performed separately one after the other, and wherein the same stated set-up of the grinding worm (4) and the dressing tool (2) a grinding worm profile (9) no longer required on the grinding worm (4) is stripped away by means of a stripping zone (6) of the dressing tool (2).

14. Dressing tool according to claim 5, wherein it is provided with an enveloping surface and the pre-profiling zone (7), the finishing profiling zone (8), and the stripping zone (6) are arranged on this enveloping surface, where these zones (6, 7, 8) are each provided with a conical enveloping surface having a conical angle and a spacing from one to the other, the angle and spacing being so dimensioned that each of these zones (6, 7, 8) can be brought into engagement with the grinding worm (4) without any other of these zones (6, 7, 8) colliding.

15. Dressing tool according to claim 5, wherein it is swivellable about a swivel axis (F) which is at right angles to an axis (12) of a dressing spindle (1) of the dressing tool (2), and the pre-profiling zone (7), the finish profiling zone (8) and the stripping zone (6) can be brought into dressing position by this swivel action.

16. Dressing tool according to claim 5, wherein abrasive coatings are provided in the pre-profiling zone (7), the finishing profiling zone (8) and the stripping zone (6), which differ from each other in at least one of the following properties: type of abrasive, grain size, coating pattern, density, bond.

17. Process according to claim 13, wherein the dressing tool (2) is swiveled about an axis (F) at right angles to the axis of rotation of the dressing tool (2), and the pre-profiling zone (7) and the finish profiling zone (8) and the stripping zone are brought into dressing position by means of this swivel action.

18. Process according to claim 13, where firstly stripping and subsequently pre-profiling and finish profiling are performed, these three machining operations being performed separately one after the other.

19. Process for the dressing of a multi-start cylindrical grinding worm (4) for grinding the tooth flanks of a gear by the continuous generation grinding process, where by the reproduction of a rib profile of a dressing tool (2) on the grinding worm a grinding worm profile (9) is produced, wherein the grinding worm profile is produced in that the grinding worm (4) is pre-profiled by means of a pre-profiling zone (7) of the dressing tool (2), and in the same set-up of the grinding worm (4) and the dressing tool (2) the grinding worm (4) is finish profiled by means of a finish profiling zone (8) of the dressing tool (2), pre-profiling being performed in a first machining operation and finish profiling being performed in a second machining operation, and these machining operations being performed separately one after the other, and wherein the relative position of the grinding worm (4) and the dressing tool (2) is altered in the form of pre-profiling strokes and finish profiling strokes parallel to the rotational axis of the grinding worm, and at least in every pre-profiling stroke all the worm threads of the grinding worm (4) are profiled in the same dressing stroke.

20. Dressing tool for dressing a multi-start cylindrical grinding worm (4) for grinding the tooth flanks of a gear by the continuous generation grinding process, wherein its periphery is provided with a pre-profiling zone (7) for the pre-profiling of the grinding worm (4) and a finish profiling zone (8) for the finish profiling of the grinding worm (4), where these two profiling zones (7, 8) can be brought into engagement with the grinding worm in separate consecutive machining operations, wherein it has an axis of rotation (12), and the pre-profiling zone (7) and the finish profiling zone (8) are arranged next to each other along this axis of rotation (12), and wherein the periphery of the dressing tool (2) is provided with a stripping zone (6) for stripping the grinding worm (4), where the stripping zone (6), the pre-profiling zone (7) and the finish profiling zone (8) can be brought into engagement with the grinding worm (4) in consecutive machining operations.

21. Dressing tool according to claim 20, wherein the stripping zone (6) is arranged alongside the pre-profiling and finish profiling zones (7, 8) in the direction of the axis of rotation (12).

22. Dressing tool according to claim 20, wherein the stripping zone (6) has a straight or cambered enveloping surface (10) and lead lands (11).

23. Dressing tool for dressing a multi-start cylindrical grinding worm (4) for grinding the tooth flanks of a gear by the continuous generation grinding process, wherein its periphery is provided with a pre-profiling zone (7) for the pre-profiling of the grinding worm (4) and a finish profiling zone (8) for the finish profiling of the grinding worm (4), where these two profiling zones (7, 8) can be brought into engagement with the grinding worm in separate consecutive machining operations, wherein the pre-profiling zone (7) has a number of profiling ribs at least equal to the number of grinding worm starts.

24. Dressing tool for dressing a multi-start cylindrical grinding worm (4) for grinding the tooth flanks of a gear by the continuous generation grinding process, wherein its periphery is provided with a pre-profiling zone (7) for the pre-profiling of the grinding worm (4) and a finish profiling zone (8) for the finish profiling of the grinding worm (4), where these two profiling zones (7, 8) can be brought into engagement with the grinding worm in separate consecutive machining operations, wherein the finish profiling zone (8) has a number of profiling ribs at least equal to or greater than the number of grinding worm starts.

25. Dressing tool for dressing a multi-start cylindrical grinding worm (4) for grinding the tooth flanks of a gear by the continuous generation grinding process, wherein its periphery is provided with a pre-profiling zone (7) for the pre-profiling of the grinding worm (4) and a finish profiling zone (8) for the finish profiling of the grinding worm (4), where these two profiling zones (7, 8) can be brought into engagement with the grinding worm in separate consecutive machining operations, wherein the preprofiling zone (7) and the finish profiling zone (8) are arranged on coaxial cylindrical surfaces of the dressing tool (2) with equal diameter.

26. Dressing tool for dressing a multi-start cylindrical grinding worm (4) for grinding the tooth flanks of a gear by the continuous generation grinding process, wherein its periphery is provided with a pre-profiling zone (7) for the pre-profiling of the grinding worm (4) and a finish profiling zone (8) for the finish profiling of the grinding worm (4), where these two profiling zones (7, 8) can be brought into engagement with the grinding worm in separate consecutive machining operations, wherein the pre-profiling zone (7) and the finish profiling zone (8) are arranged on coaxial cylindrical surfaces of the dressing tool (2), where the diameter of the finish profiling zone (8) is greater than the diameter of the pre-profiling zone (7) by twice the amount of a desired finish profiling infeed depth.

27. Dressing tool for dressing a multi-start cylindrical grinding worm (4) for grinding the tooth flanks of a gear by the continuous generation grinding process, wherein its periphery is provided with a pre-profiling zone (7) for the pre-profiling of the grinding worm (4) and a finish profiling zone (8) for the finish profiling of the grinding worm (4), where these two profiling zones (7, 8) can be brought into engagement with the grinding worm in separate consecutive machining operations, wherein the dressing tool (2) is made in one piece.

28. Dressing tool for dressing a multi-start cylindrical grinding worm (4) for grinding the tooth flanks of a gear by the continuous generation grinding process, wherein its periphery is provided with a pre-profiling zone (7) for the pre-profiling of the grinding worm (4) and a finish profiling zone (8) for the finish profiling of the grinding worm (4), where these two profiling zones (7, 8) can be brought into engagement with the grinding worm in separate consecutive machining operations, wherein abrasive coatings are provided in the pre-profiling zone (7) and the finish profiling zone (8), which differ from each other in at least one of the following properties: type of abrasive, grain size, coating pattern, density, bond.

29. Dressing tool for dressing a multi-start cylindrical grinding worm (4) for grinding the tooth flanks of a gear by the continuous generation grinding process, wherein its periphery is provided with a pre-profiling zone (7) for the pre-profiling of the grinding worm (4) and a finish profiling zone (8) for the finish profiling of the grinding worm (4), where these two profiling zones (7, 8) can be brought into engagement with the grinding worm in separate consecutive machining operations, wherein it has an axis of rotation (12), and the pre-profiling zone (7) and the finish profiling zone (8) are arranged next to each other along this axis of rotation (12), wherein the periphery of the dressing tool (2) is provided with a stripping zone (6) for stripping the grinding worm (4), where the stripping zone (6), the pre-profiling zone (7) and the finish profiling zone (8) can be brought into engagement with the grinding worm (4) in consecutive machining operations, and wherein abrasive coatings are provided in the pre-profiling zone (7), the finish profiling zone (8) and the stripping zone (6), which differ from each other in at least one of the following properties: type of abrasive, grain size, coating pattern, density, bond.

* * * * *